US005244421A

United States Patent [19]

Jinno et al.

[11] Patent Number: 5,244,421

[45] Date of Patent: Sep. 14, 1993

[54] CONNECTOR LOCKING MECHANISM

[75] Inventors: Keishi Jinno; Tamio Watanabe; Sakai Yagi; Takayoshi Endo, all of Shizuoka, Japan

[73] Assignee: Yazaki Corporation, Tokyo, Japan

[21] Appl. No.: 888,637

[22] Filed: May 27, 1992

[30] Foreign Application Priority Data

Jun. 12, 1991 [JP] Japan ..... 3-140264

[51] Int. Cl.[5] ..... H01R 13/514

[52] U.S. Cl. ..... 439/752; 439/595

[58] Field of Search ..... 439/595, 752

[56] References Cited

U.S. PATENT DOCUMENTS 5,066,253 11/1991 Kameyama ..... 439/752

FOREIGN PATENT DOCUMENTS 234083 3/1990 Japan .

*Primary Examiner*—Eugene F. Desmond

*Attorney, Agent, or Firm*—Sughrue Mion Zinn Macpeak & Seas

[57] ABSTRACT

This invention is to provide a connector for use in connection of a wire harness and the like, a structure of a connector housing and a terminal locking member to be coupled thereto which can prevent the after-removal of a terminal to be inserted into a terminal accommodating chamber provided in the connector housing. According to the present invention, in the inner surface of the side wall of each terminal accommodating chamber provided in a connector housing, there is formed a guide groove which is used to guide the- two outsides of a pair of flexible locking pieces, respectively provided in a terminal locking member.

1 Claim, 6 Drawing Sheets

CONNECTOR LOCKING MECHANISM

BACKGROUND OF THE INVENTION

The present invention relates to the structure of a connector to be used for connection of a wire harness and the like and, in particular, to the structure of a connector housing and a terminal locking member to be connected thereto in order to prevent the after-removal of terminals respectively to be inserted into terminal accommodating chambers which are respectively provided in the connector housing.

In FIG. 6, there is shown a perspective view of a connector housing a and a terminal locking member b according to the conventional device described in Japanese Unexamined Patent Publication No. 2-34083.

Within the connector housing a, a plurality of terminal accommodating chambers c are provided in parallel to each other in two upper and lower layers, and flexible locking arms n are provided extending in parallel to each other forwardly from the walls of the terminal accommodating chambers c to form lock means with respect to terminals m. On the outside of the connector housing a, there is provided a locking projection p on a lock arm d, which projection p is retained with its mating female connector housing.

The terminal locking member b includes a frame-shaped main body f having a plurality of insertion portions e into which the terminals m and electric wires to be connected thereto can be inserted, and a plurality of flexible locking pieces g which are respectively extended forwardly of the main body f and correspond to the plurality of terminal accommodating chambers c arranged in the two upper and lower layers. The terminal locking member b further includes in the two side portions thereof two lock arms h, h which are similarly extended in parallel to each other forwardly of the main body f and are retained with the connector housing a. The lock arm h includes a vertically flexible piece $h_1$ on which a temporarily locking projection ha is provided, and a horizontally flexible piece $h_2$ on which a real locking projection hb is provided. The real locking projection hb is positioned in the rear of the temporarily locking projection ha.

The connector housing a includes side walls i, i. In the rear portions of the side walls i, i, there are provided bulged walls j, j and there are also formed s receiving portions k, k which are used to receive the lock arms h, h, respectively. In the rear end of the bulged wall j and on the opposed side of the receiving portion k, there are provided an locking portion (not shown) with respect to the temporarily locking projection ha and an locking portion (not shown) with respect to the real locking projection hb.

As constructed in the above-mentioned manner, in use, the connector housing a and terminal locking member b are in the temporarily connected state in which the temporarily locking projection ha in the vertically flexible piece h is in engagement with the locking portion of the receiving portion k, prior to insertion of the terminals m. In this state, the terminals m connected to the electric wire is inserted from the insertion portion e of the terminal locking member b into the terminal accommodating chamber c, while the leading end $n_1$ of a flexible locking arm n is locked with the terminal edge $m_2$ of the terminals m.

Next, the terminal locking member b is inserted until the real locking projection hb of the lock arm h is retained with the above-mentioned engaging portion inside of the bulged wall j. At that time, as shown in FIG. 7, the leading end $g_1$ of the flexible locking piece g of the terminal engagement member b is in contact with the end edge $m_1$ of a stabilizer provided in the terminal m to thereby prevent the after-removal of the terminal m.

Referring now to FIG. 8(*a*), there is shown a transverse section view of the terminal metal m, illustrating a state in which the leading end $g_1$ of the flexible locking piece g of the terminal locking member b is in contact with the terminal edge $m_1$ of the stabilizer of the terminal m. A width r between the outsides of the terminal edges $m_1$, $m_1$ of a pair of stabilizers is slightly smaller than a width q of the terminal accommodating chamber c, that is, play is present between them. Further, a width s between the outsides of a pair of leading ends $g_1$, $g_1$ of the flexible locking piece g is also slightly smaller than the width q of the above terminal accommodating chamber c, that is, play is also present between them. Therefore, if their terminal m is given a withdrawing force in a direction of D which is greater than necessary, then the above-mentioned two kinds of play are combined and, as shown in FIG. 8(*b*), the respective leading ends $g_1$ of the flexible locking pieces g are caused to deflect inwardly, so that the flexible locking pieces g fail to perform their functions to secure the terminal m. As a result of this, the withdrawing force is too strong to be supported only by the flexible locking arm n (see FIG. 7) of the connector housing a, so that the terminal m will be removed or slipped off from the connector housing a.

SUMMARY OF THE INVENTION

The present invention aims at eliminating the drawbacks found in the above-mentioned conventional connector structure. Accordingly, it is an object of the invention to provide, in a connector for use in connection of a wire harness and the like, a connector housing and a terminal locking member which are structured to be able to prevent the after-removal of a terminal to be inserted into the terminal accommodating chamber of the connector housing.

In order to achieve the above object, according to the invention, there is provided a connector which comprises a connector housing having a plurality of terminal accommodating chambers, a plurality of terminal respectively to be inserted into the respective terminal accommodating chambers, and a terminal locking member to be connected to the rear portion of the connector housing in two states consisting of a temporarily connected state and a real connected state, wherein a plurality of guide grooves respectively for guiding a plurality of flexible locking pieces respectively provided in and extending from the terminal locking member are formed in the inner surfaces of the side walls of the terminal accommodating chambers of the connector housing, and there is employed a structure in which a plurality of tapered portions are respectively formed in the leading ends of the flexible locking pieces provided in and extending from the terminal locking member.

According to the present invention, the guide grooves reading the flexible locking pieces of the terminal lock member locking the terminal, respectively, are formed in the inner surface of the side walls of the terminal accommodating chambers of the connector housing, and the flexible locking pieces are retained such that their respective end portions project outwardly stabilizers respectively provided in the terminals, thereby absorbing shift caused by play present between the stabilizers of the terminals and the end portions of the flexible locking pieces. As a result, even if a force to draw out the terminals is given, the end portions of the flexible locking pieces are prevented from falling down inwardly to thereby prevent the after-removal of the terminals. Further, due to provision of the tapered portions in the end portions of the flexible engaging pieces, if a force to draw out the terminals is applied, then the component of the drawing-out force presses the end portions of the flexible locking pieces against the side surfaces of the side walls of the terminal accommodating chambers to thereby prevent the end portions of the flexible locking pieces from falling down inwardly.

DETAILED DESCRIPTION OF THE PREFERRED EMBODIMENTS

Figure 1:
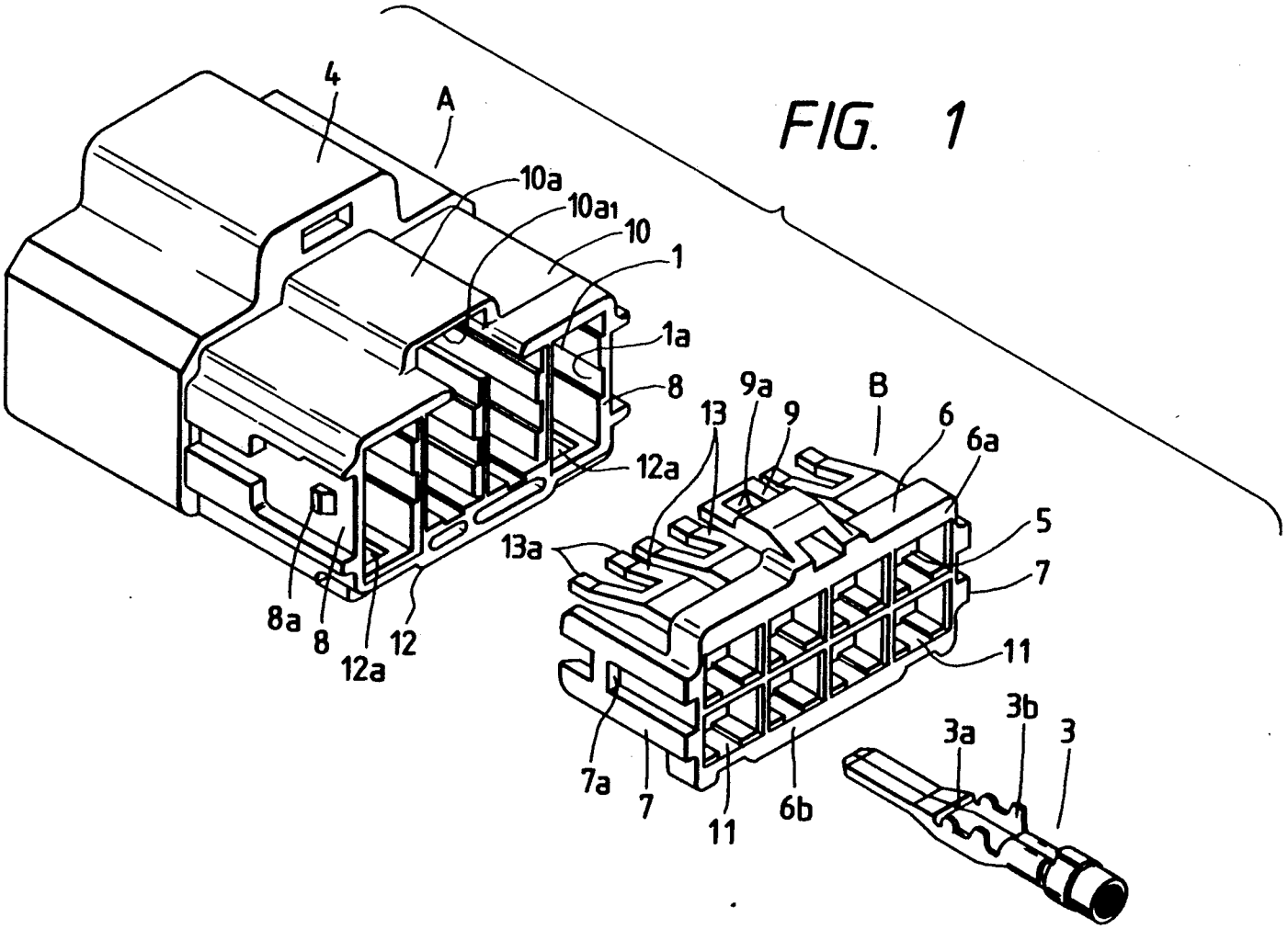
FIG. 1 is an exploded perspective view of an embodiment of a connector dual locking mechanism according to the invention.

Referring now to FIG. 1, there is shown a perspective view of a connector housing A and a terminal locking member B which form a first embodiment according to the invention.

Within the connector housing A, a plurality of terminal accommodating chambers 1 are provided in parallel in two upper and lower layers. A flexible locking arm 2 is extended forwardly from the wall of the terminal accommodating chamber 1 to form locking means with respect to a terminal 3. On the outside of the connector housing A, there is provided a bulged wall 4 which includes therein a locking portion for engagement with a flexible lock arm provided in a mating or opponent male connector housing. In the inner surfaces of the side walls of each of the terminal accommodating chambers 1, there are formed a pair of guide grooves la each with a depth of d, which guide grooves are used to guide the two outsides of each of a pair of flexible locking pieces 13, 13 provided in the terminal locking member B (which will be discussed later) with respect to one piece of the terminals 3 (see FIG. 4(*a*)).

The terminal locking member B includes a frame-shaped main body 6 having therein a plurality of insertion portions 5 into which the terminal 3 and electric wires respectively connected thereto can be inserted, and a plurality of flexible engaging pieces 13 respectively extended forwardly of the main body 6 and corresponding to the plurality of terminal accommodating chambers 1 arranged in the above-mentioned two upper and lower layers. Further, the terminal locking member B includes on the two side portions thereof a pair of lock arms 7, 7 which are similarly extended forwardly and are flexible with respect to the connector housing A. The lock arm 7 comprises two cylindrical members which are connected together by a connecting portion 7*a*. The connecting portion 7*a* forms real locking means with a real locking projection 8*a* provided on the outside of each of a pair of side walls 8, 8 of the connector housing A. The terminal locking member B includes on the top portion 6*a* of the main body 6 thereof two flexible lock arms 9, 9 which extend in parallel to each other and the leading ends of which are connected together by a connecting portion 9*a*. The connecting portion 9*a* forms real locking means with a real locking projection $\mathbf{10}a_1$ provided on the inner surface of a bulged wall 10*a* which is provided in a top wall 10 of the connector housing A. The main body 6 includes a bottom portion 6*b* which extends in the insertion portions 5 located in the lower stage. In the bottom portion 6*b* of the two outer insertion portions 5 in the lower layer, there are provided two lock arms 11, 11 each of which includes a temporarily locking projection 11*a* in the leading end thereof. The lock arm 11 forms temporarily locking means with an edge portion of a temporarily locking hole 12*a* formed in a bottom wall 12 which is provided in each of the two outer-most terminal accommodating chambers 1 in the lower stage of the connector housing A.

Figure 2:
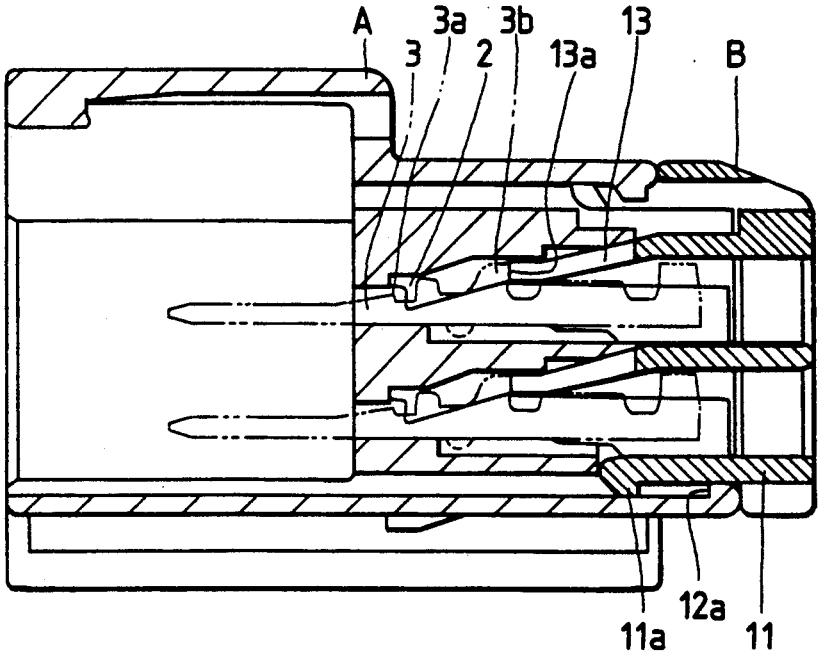
FIG. 2 is a longitudinal section view of an embodiment according to the invention, illustrating a state in which the embodiment is retained in its real locked state.
Figure 3A:
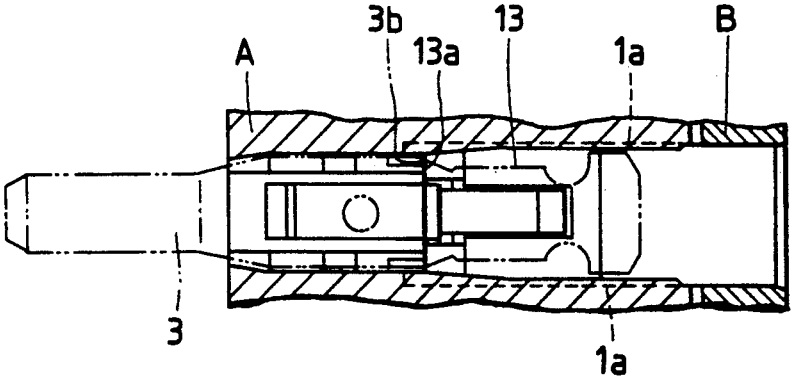
FIG. 3(*a*) is a longitudinal section view of a terminal included in the embodiment of the invention, illustrating the locked state of the terminal and FIG. 3(*b*) is a side view of the terminal.
Figure 3B:
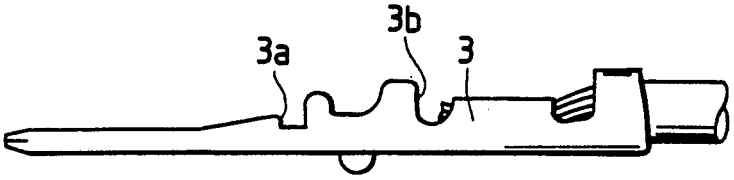

Due to the above-mentioned structure, in use, the connector housing A and the terminal locking member B, prior to insertion of the terminal 3, are connected together in a temporarily locked state in which the temporarily locking projections 11*a* of the lock arms 11 provided in the bottom portion 6*b* of the two outermost insertion portions 5 in the lower stage of the terminal locking member B are retained with the temporarily locking holes 12*a* formed in the bottom wall 12 of the connector housing A. Next, the terminal 3 is inserted through the insertion portion 5 of the terminal locking member B into a desired terminal accommodating chamber 1 of the connector housing A. In this insertion, a terminal edge 3*a* of the terminal, which is shown in FIG. 3(*b*), is retained with a leading end 2*a* of the flexible locking arm 2 which is extended from the wall of the terminal accommodating chamber 1 of the connector housing A. After then, the terminal locking member B is inserted into the connector housing A up to a position in which the connecting portion 9*a* of the lock arm 9 of the terminal locking member B is retained with the real locking projection $\mathbf{10}a_1$ of the bulged wall 10*a* of the connector housing A and the connecting portion 7*a* of the lock arm 7 of the terminal locking member B is retained with the real locking projection 8*a* of the side wall 8 of the connector housing A, that is, the terminal locking member B is inserted until it is connected in a real locked state with respect to the connector housing A (see FIG. 2). In this state, the terminal edge 3b of the stabilizer provided in the terminal 3 is engaged with an end portion of 13a of the flexible locking piece 13 of the terminal locking member B to thereby prevent the after-removal of the terminal 3.

Figure 4A:
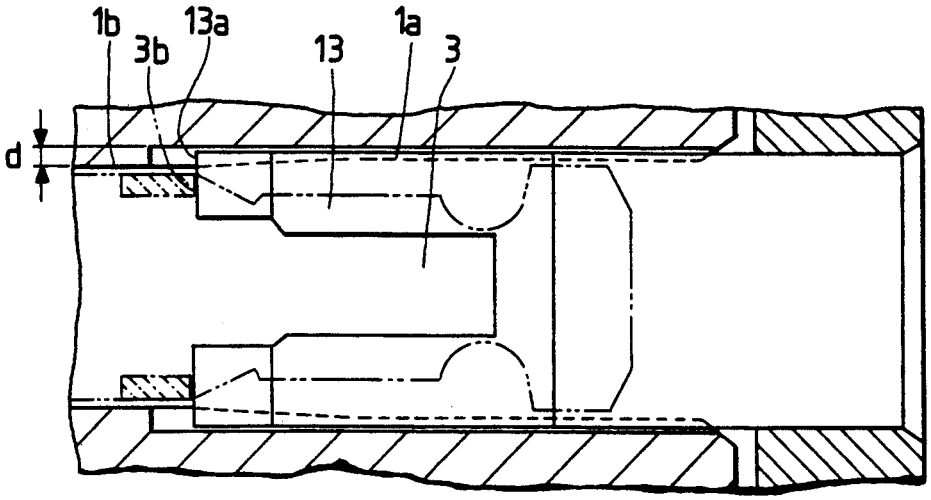
FIGS. 4(*a*) and 4(*b*) are longitudinal section views of the main portions of the terminal included in the embodiment of the invention, illustrating the locked state of the terminal.
Figure 4B:
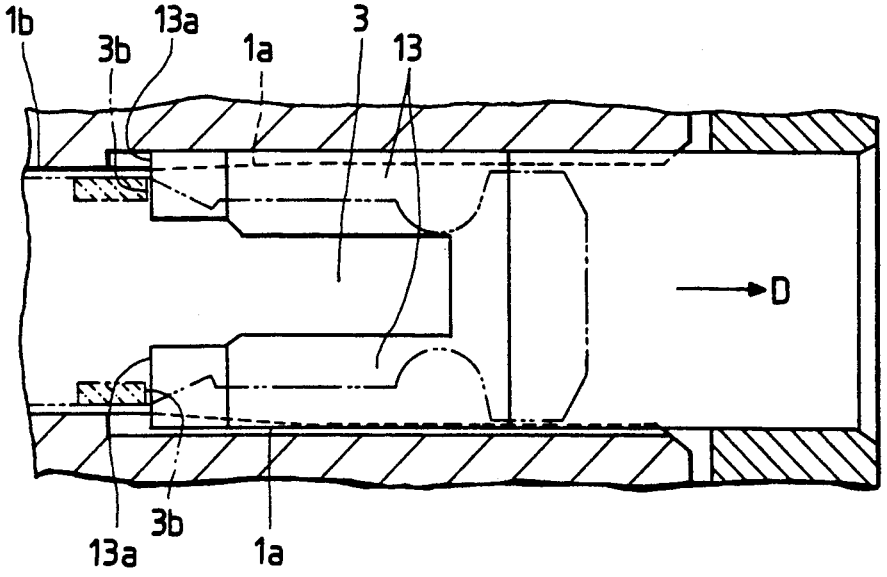

Now, in FIG. 3(*a*), there is shown a transverse section view of an locked state of the terminal 3 in which the terminal edge 3b of the stabilizer of the terminal 3 in the real locked state is retained with the end portion 13a of the flexible locking piece 13. In FIG. 4(*a*), there is shown an enlarged view of the main portions of the terminal 3 shown in FIG. 3(*a*). In these figures, since the flexible locking piece 13 is guided into the guide groove la formed in each of the terminal accommodating chambers 1, the flexible locking piece 13 retains the terminal edge 3b of the stabilizer of the terminal 3 in such a manner that the terminal edge 3b is projected by the depth d of the guide groove 1a outwardly from the inner surface 1b of the side wall of the terminal accommodating chamber 1. In this structure, even if the end portion 13a and the stabilizer terminal edge 3b are biased mutually in the opposite direction due to the play existing between them, as shown in FIG. 4(*b*), there is no possibility that the end portion 13a of the flexible locking piece 13 can slip off from the stabilizer terminal edge 3b. For this reason, even if there is given a force to remove the terminal 3 in a direction of D, the entire surface of the stabilizer terminal edge 3b can always be received by the end portion 13a of the flexible locking piece 13. In other words, according to the present structure, there is eliminated the possibility that the end portion 13a may be deflected inwardly to fail to bear the force to remove the terminal metal plate as in the conventional structure.

Figure 5A:
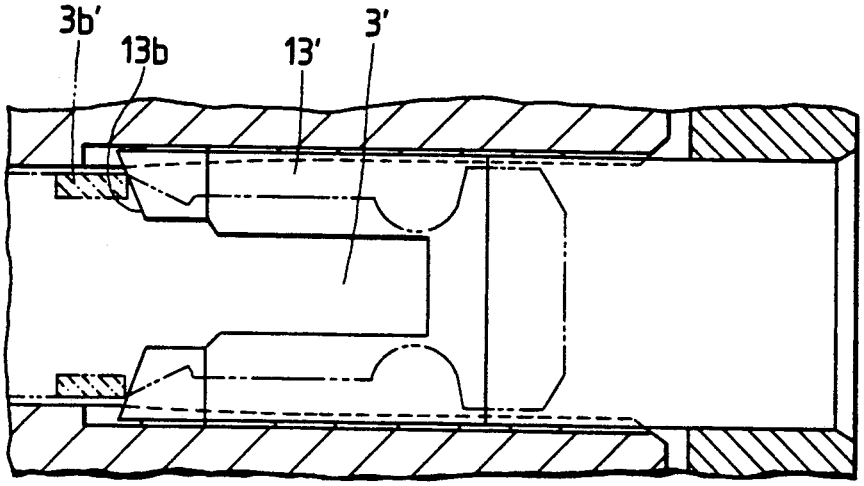
FIGS. 5(*a*) and 5(*b*) are longitudinal section views of the main portions of a terminal employed in a second embodiment according to the invention, illustrating the locked state of the terminal.
Figure 5B:
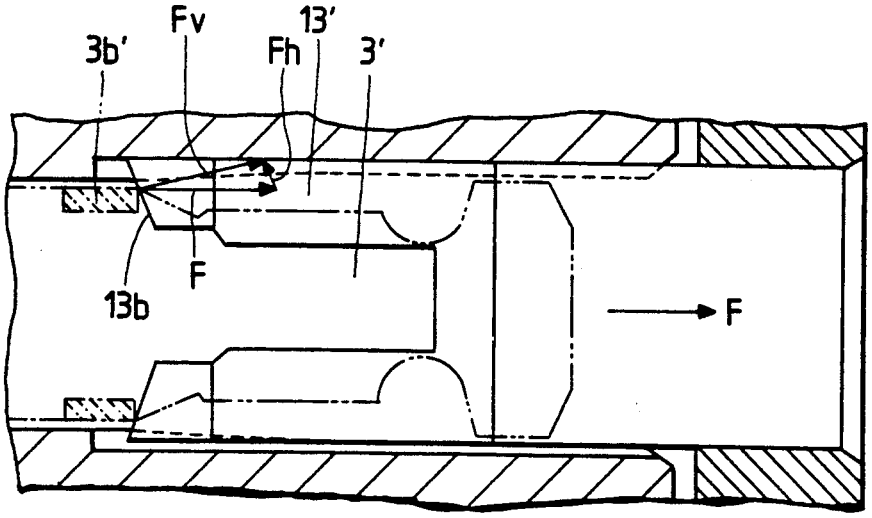
Figure 6:
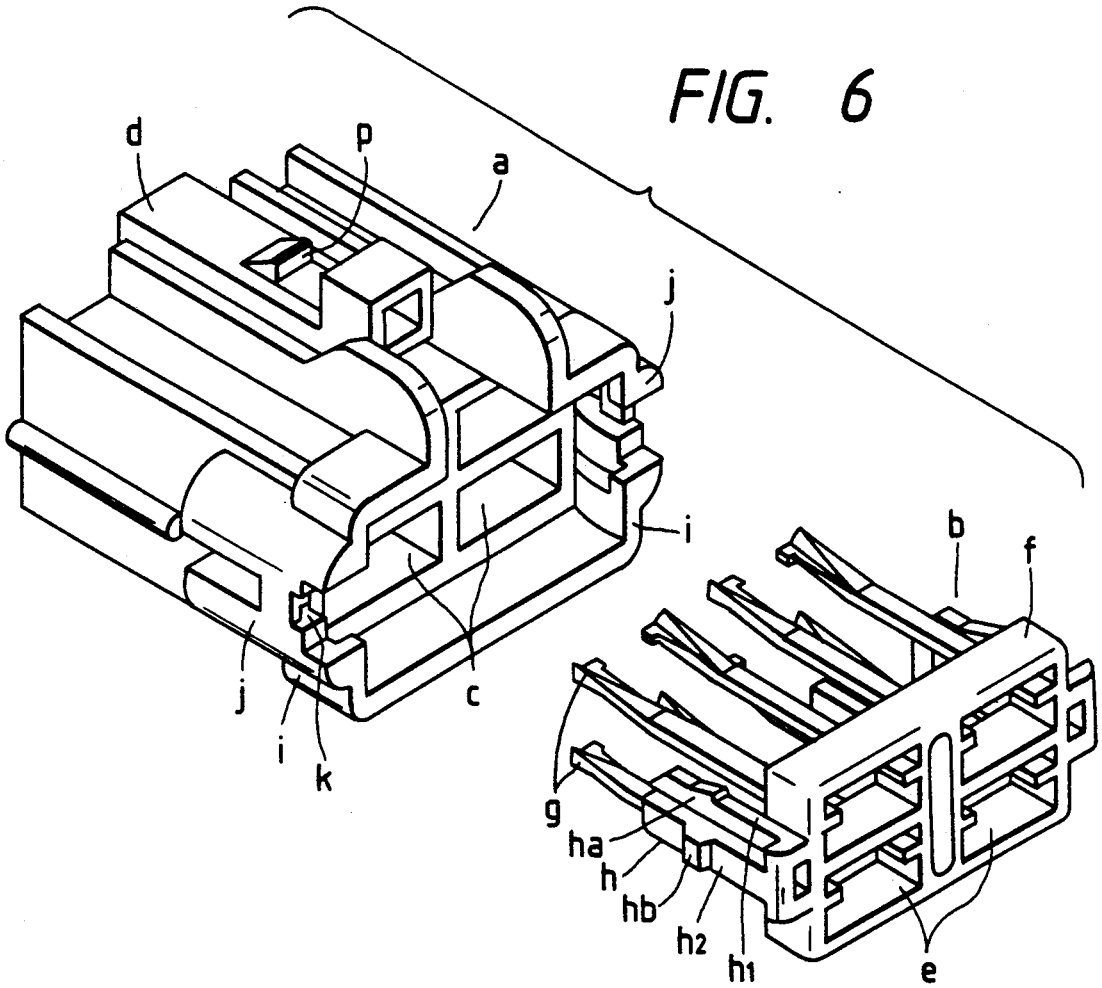
FIG. 6 is an exploded perspective view of a connector locking mechanism according to the conventional art.
Figure 7:
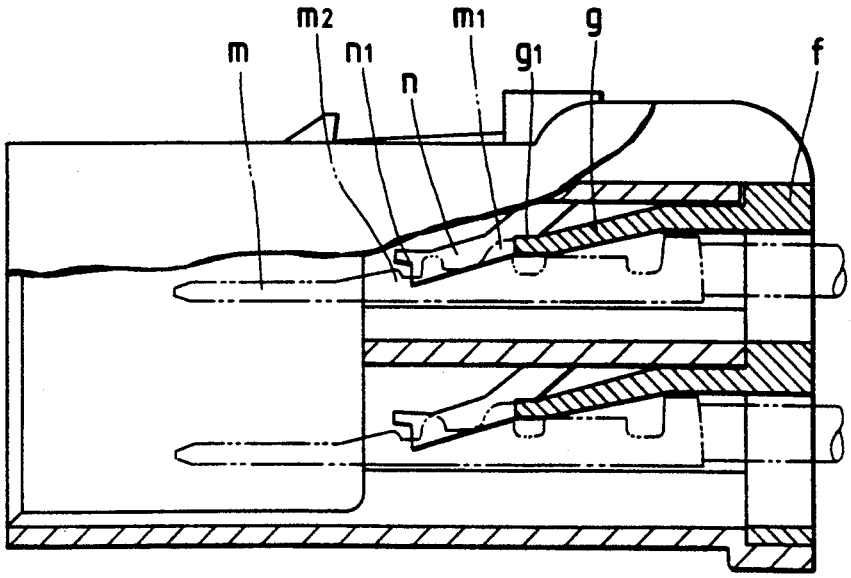
FIG. 7 is a longitudinal section view of the conventional connector locking mechanism, illustrating a state in which a connector housing and a terminal are engaged in their really locked state; and, FIGS. 8(*a*) and 8(*b*) are longitudinal section views of the main portions of the conventional terminal while it is locked.
Figure 8A:
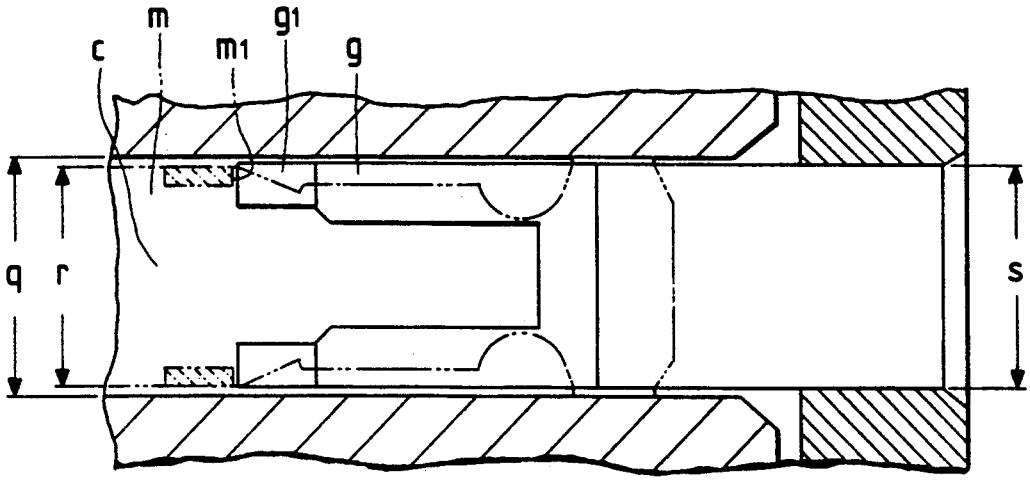
Figure 8B:
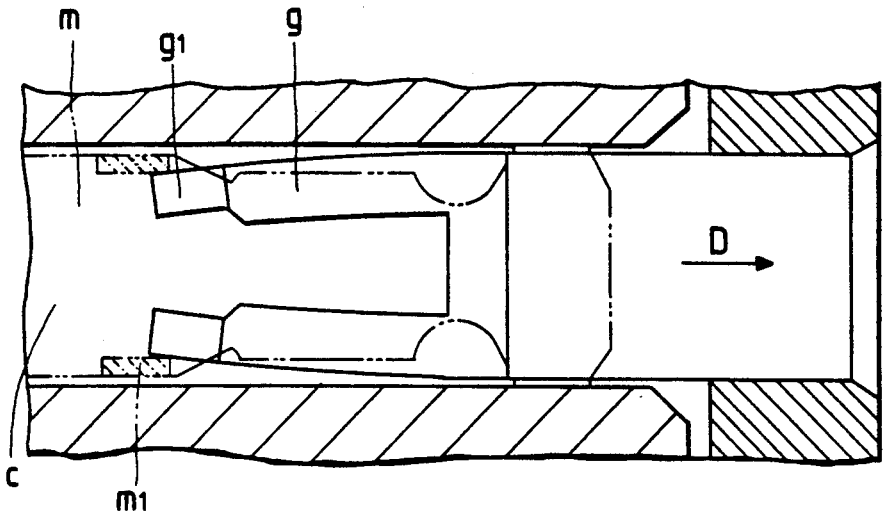

Referring now to FIG. 5(*a*), there is shown a second embodiment of the present invention, in which a flexible locking piece 13' includes in the leading end portion thereof a tapered portion 13b which is inclined inwardly. Other components are similar in structure to those employed in the first embodiment and thus the description thereof is omitted here.

As the second embodiment is constructed in this manner, description will be given below of only differences between the second embodiment and the first embodiment when in use. In FIG. 5(*b*), there is shown a state of a terminal 3' in which the flexible locking piece 13 is biased to its maximum, as shown in FIG. 4(*b*). In this state, if there is applied to the terminal 3' a force F in a direction of D' to draw out the terminal 3', then the drawing-out force F is decomposed into a force Fh extending along the tapered portion 13b and a force Fv extending perpendicularly to the tapered portion 13b. The force Fh extending along the tapered portion 13b provides a force to press the tapered portion 13b of the leading end portion of the flexible locking piece 13' against a guide groove la, to thereby prevent the tapered portion 13b of the leading portion of the flexible locking piece 13 from deflected inwardly as in the conventional structure, so that the after-removal of the terminal 3' can be surely prevented.

Since the present invention has been constructed in the above-mentioned manner, in a connector for use in connection of a wire harness or the like, in the inner surface of the side wall of a terminal accommodating chamber in a connector housing there is formed a guide groove which is used to guide a flexible locking piece of a terminal locking member for engagement of a terminal, and the terminal is engaged in such a manner that the end portion of the flexible locking piece is projected outwardly of a stabilizer of the terminal, thereby absorbing shift caused by play existing between the stabilizer of the terminal and the end portion of the flexible locking piece. Accordingly, even if there is applied a force to remove or draw out the terminal, the present invention can prevent the end portion of the flexible locking piece from falling down inwardly to thereby prevent the after-removal of the terminal. Further, due to provision of a tapered portion in the end portion of the flexible locking piece, when the force to draw out the terminal is applied to the terminal, the present invention can provide an effect that the force presses the end portion of the flexible locking piece against the guide groove to thereby prevent the after-removal of the terminal to be inserted into the terminal accommodating chamber of the connector housing.

What is claimed is:

1. A connector for connecting a plurality of terminals each having a stabilizer on opposite sides thereof including a rearwardly facing surface facing in a rearward direction, said connector comprising:

a connector housing having a plurality of terminal accommodating chambers, side surfaces of each of said accommodating chambers having a recessed groove therein, a terminal locking member, for locking a terminal within said terminal accommodating chamber, and being moveable from a temporarily locked position to a complete locked position, said terminal locking member including an engaging prong extending therefrom in a forward direction for engaging said rearwardly facing surface of said terminal when said locking member is in said completely locked position to prevent removal of said terminal wherein said engaging prong is at least partially disposed in said recessed groove and includes a tapered end surface which engages said rearwardly facing surface, said tapered end surface being tapered such that an outermost surface thereof extends longitudinally further into said chamber than an innermost surface thereof such that when said terminal tends to move in said rearward direction said prong is urged slightly outwardly against a bottom of said groove so that said terminal remains positively engaged by said prong.

* * * * *